US010190389B2

(12) United States Patent
Bane

(10) Patent No.: US 10,190,389 B2
(45) Date of Patent: Jan. 29, 2019

(54) HIGH PRESSURE INTERVENTIONLESS BOREHOLE TOOL SETTING FORCE

(71) Applicant: BAKER HUGHES, A GE COMPANY, LLC, Houston, TX (US)

(72) Inventor: Darren E. Bane, Tomball, TX (US)

(73) Assignee: BAKER HUGHES, A GE COMPANY, LLC

( * ) Notice: Subject to any disclaimer, the term of this patent is extended or adjusted under 35 U.S.C. 154(b) by 99 days.

(21) Appl. No.: 15/355,613

(22) Filed: Nov. 18, 2016

(65) Prior Publication Data

US 2018/0142530 A1 May 24, 2018

(51) Int. Cl.

| | |
|---|---|
| ***E21B 23/04*** | (2006.01) |
| ***E21B 34/08*** | (2006.01) |
| ***E21B 34/10*** | (2006.01) |
| ***E21B 34/06*** | (2006.01) |
| ***E21B 23/06*** | (2006.01) |

(52) U.S. Cl.

CPC ..... *E21B 34/063* (2013.01); *E21B 23/04* (2013.01); *E21B 23/06* (2013.01); *E21B 34/08* (2013.01); *E21B 34/10* (2013.01)

(58) Field of Classification Search

CPC .... E21B 23/04; E21B 33/1295; E21B 34/063; E21B 34/08; E21B 34/10

See application file for complete search history.

(56) References Cited

U.S. PATENT DOCUMENTS

| | | | | |
|---|---|---|---|---|
| 2,545,306 | A * | 3/1951 | Pollard, Jr. | E21B 49/10 166/100 |
| 5,415,237 | A | 5/1995 | Strattan | |
| 9,309,745 | B2 | 4/2016 | Patel | |
| 2003/0041596 | A1 | 3/2003 | Flerchinger et al. | |
| 2005/0224235 | A1 | 10/2005 | Patel | |
| 2009/0229832 | A1 | 9/2009 | King | |
| 2010/0206579 | A1 | 8/2010 | Guven et al. | |
| 2016/0208578 | A1 * | 7/2016 | Guzman | E21B 34/14 |

* cited by examiner

*Primary Examiner* — Cathleen R Hutchins
(74) *Attorney, Agent, or Firm* — Shawn Hunter

(57) ABSTRACT

A high pressure compressed gas source is separated from an actuation piston by a pilot valve that is selectively operated with raising annulus pressure to break a rupture disc to provide access to a shuttle type valve. Movement of the shuttle valve using pressure applied to opposing pistons of different sizes connected to a common shaft translates the shaft against a spring bias to open the valve on the high pressure source. This allows the high pressure to reach the actuating piston to operate the tool. One application can be setting a packer without well intervention.

12 Claims, 1 Drawing Sheet

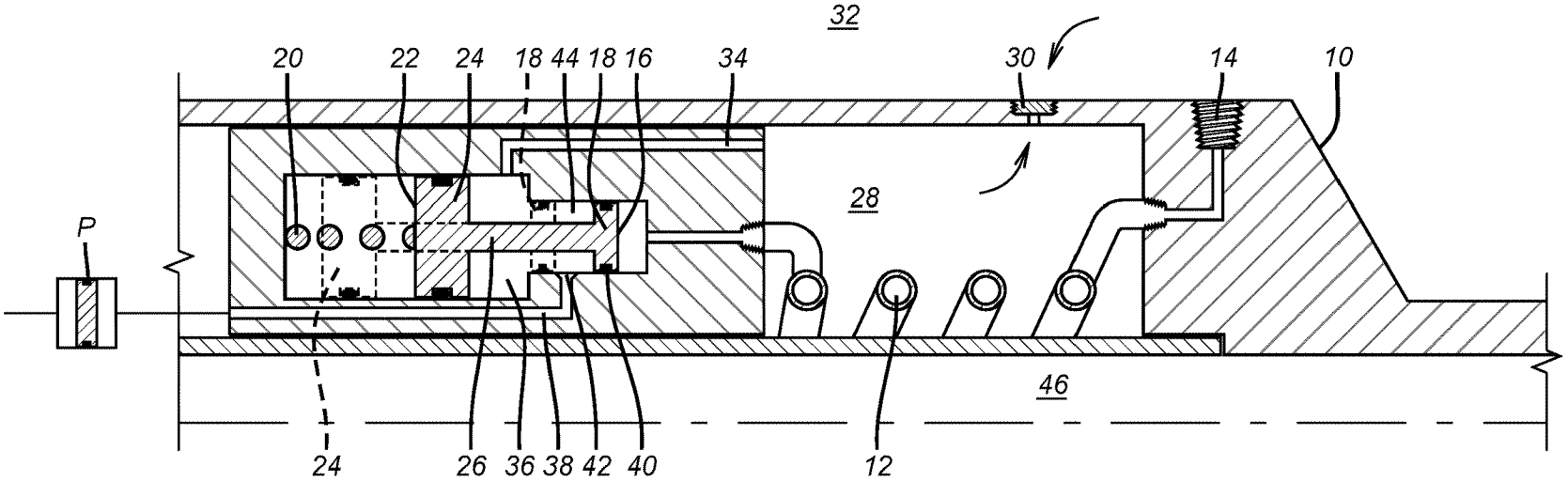
10
14
30
32
28
34
16
18
44
18
24
22
20
46
12
40
42
38
36
26
24
P

HIGH PRESSURE INTERVENTIONLESS BOREHOLE TOOL SETTING FORCE

FIELD OF THE INVENTION

The field of the invention is setting mechanisms for borehole tools that need high actuation force and more particularly where the actuation force is non-interventionally released from a remote location with a pilot circuit.

BACKGROUND OF THE INVENTION

Tools have been set before using available annulus hydrostatic pressure that is allowed to selectively move actuation systems when a barrier is broken. One example of such a design is US 2009/0229832 where annulus pressure at a desired location is raised to break a rupture disc to then allow pressure to release a lock and move an actuation mechanism to set a packer. However, there is a limit to the amount of force that such systems that use pressures slightly higher than hydrostatic to actuate a tool. The present invention seeks to address this issue with the use of a stored potential energy force that can be selectively released to set a tool such as a packer. The use of a pressurized inert gas such as nitrogen allows the use of a much smaller actuation piston thereby making the internal packer drift dimension larger to enhance production capability. In a preferred embodiment annulus hydrostatic and optionally some added applied surface pressure are used to break a rupture disc to allow pressure in the annulus to operate a shuttle valve to open the high pressure source to the actuating piston. These and other aspects of the present invention will be more readily apparent from a review of the description of the preferred embodiment and the associated drawing while recognizing that the full scope of the invention is to be found in the appended claims.

US 2003/0041596 is cited to illustrate the use of pilot valves 44 to operate other valves 46 in hydraulic circuits in the context of a garbage truck using a pilot line 70.

SUMMARY OF THE INVENTION

A high pressure compressed gas source is separated from an actuation piston by a pilot valve that is selectively operated with raising annulus pressure to break a rupture disc to provide access to a shuttle type valve. Movement of the shuttle valve using pressure applied to opposing pistons of different sizes connected to a common shaft translates the shaft against a spring bias to open the valve on the high pressure source. This allows the high pressure to reach the actuating piston to operate the tool. One application can be setting a packer without well intervention.

BRIEF DESCRIPTION OF THE DRAWING

The FIGURE illustrates the hydraulic circuit for actuating a borehole tool.

DETAILED DESCRIPTION OF THE PREFERRED EMBODIMENT

The FIGURE illustrates a housing 10 that defines a high pressure fluid chamber 12 in a coiled shape that is accessed for charging by a connection 14. Chamber 12 has pressures orders of magnitude higher than annulus 32 pressure and could be in the order of 5000 PSI or more. Chamber 12 communicates with face 16 of piston 18 and that force is resisted by spring 20 pushing against face 22 of piston 24. Pistons 18 and 24 are held together by shaft 26 for tandem movement to the left as shown by the dashed positions of pistons 18 and 24.

Chamber 28 is accessed from removal of barrier 30 from the surrounding annulus 32 preferably by raising the hydrostatic pressure in annulus 32. Pressure in chamber 28 communicates through passage 34 to pilot chamber 36 after barrier 30, which is preferably a rupture disc, breaks. Pressure in chamber 36 creates a net force against spring 20 because the diameter of piston 24 is larger than piston 18. When pistons 18 and 24 move to their dashed positions pressure in chamber 12 is communicated through passage 38 to actuate a setting piston P for a borehole tool that is not shown. This occurs because piston 18 has a seal 40 that crosses over opening 42 into passage 38 while remaining in bore 44. Spring 20 is compressed as pistons 18 and 24 move left. Piston 18 stays in bore 44.

Those skilled in the art will appreciate that there can be many variations to the concept of actuation without intervention coupled with the use of a high pressure source that is released to move an actuation piston to actuate a borehole tool. For example, the rupture disc 30 can be replaced with a disintegrating plug that responds to well fluids or thermal inputs. The barrier 30 can be a shape memory material that changes shape after exposure to temperatures above a critical temperature to change shape to allow fluid communication to the chamber 28 from the annulus 32. Motorized sleeve valves are also contemplated but represent a more complicated way to provide access to the annulus 32. Alternatively the access can be from the tubing side using passage 46 although a wall opening to the tubular string is generally less preferred by operators than using access and pressure from annulus 32 for the access to pressure to move the pistons 18 and 24.

The coil spring 20 can be replaced with a stack of Belleville washers or a pressurized compressible gas to maintain the pistons 18 and 24 in the initial position. While chamber 12 is represented as a volume inside a coil for the provision of some flexibility to the applied pressure or to compensate for thermal loads other volume shapes are contemplated such as cylindrical. The rate of piston movement can be controlled after access is obtained from the annulus 32 or the tubing 46. In another option the pressure source for moving the tandem pistons 18 and 24 can also be contained in housing 10 so that access to the tubing or the annulus is avoided. In this case the pilot gas pressure can be remotely released with a variety of signals to open a valve on the pilot gas supply to operate a valve to release the high pressure gas supply to the tool operating piston. Of course, this will add complication to the actuation system including a local power supply to receive and process a signal and then operate a motor to open a valve on the low pressure pilot supply system. Another alternative can be to have only a high pressure gas supply with a remotely actuated valve responsive to an interventionless signal that is locally processed to actuate a single valve on the high pressure reservoir to communicate it to the setting piston. The issue here may be the power requirements for the actuator to move a single valve holding back very high pressure upward of 5000 PSI.

The above description is illustrative of the preferred embodiment and many modifications may be made by those skilled in the art without departing from the invention whose scope is to be determined from the literal and equivalent scope of the claims below:

I claim:

1. An actuation assembly for an actuation piston operated borehole tool operable in a borehole, comprising:

an actuation chamber containing a pressurized fluid during delivery into the borehole, said pressurized fluid selectively isolated from the actuation piston by a valve further comprising a valve member, said valve member responsive to hydrostatic pressure selectively reaching said valve member from removal of a barrier communicating pressure in an annulus about said actuation chamber to said valve member, whereupon movement of said valve member communicates said previously isolated pressurized fluid to said actuation piston to operate the borehole tool; and said valve member comprises connected spaced apart pistons of unequal surface area defining a pilot chamber therebetween.

2. The assembly of claim 1, wherein:

said barrier is removed through an annulus surrounding the borehole tool.

3. The assembly of claim 1, wherein:

said removal of said barrier further comprises enhanced pressure applied to said annulus around the borehole tool.

4. The assembly of claim 1, wherein:

fluid in a surrounding annulus around the borehole tool removes said barrier leading to said valve member by disintegration.

5. The assembly of claim 1, wherein:

said barrier breaks or moves to expose a port.

6. The assembly of claim 1, wherein:

said removal of said barrier communicates pressure from said annulus surrounding the borehole tool to said pilot chamber to create a net force on said valve member.

7. The assembly of claim 6, wherein:

said net force is opposed by a bias force acting on said valve member.

8. The assembly of claim 6, wherein:

a smaller of said spaced apart pistons initially blocks an actuation passage between said pressurized fluid and the actuation piston until pressure in said pilot chamber moves said smaller piston from a first to a second position where said actuation passage is opened to said actuating piston.

9. The assembly of claim 8, wherein:

said smaller of said spaced apart pistons remains in a surrounding bore to retain pressure from said actuation chamber as said pressurized fluid is communicated to said actuation piston.

10. The assembly of claim 8, wherein:

a bias force acts on a larger of said spaced apart pistons to maintain said first position of said smaller of said spaced apart pistons.

11. The assembly of claim 10, wherein:

said bias force is located outside of said pilot chamber.

12. The assembly of claim 11, wherein:

said bias force comprises one of a coiled spring, a stack of Belleville washers and a pressurized compressible gas.

* * * * *